United States Patent [19]

Bhalla et al.

[11] Patent Number: 4,475,065

[45] Date of Patent: Oct. 2, 1984

[54] METHOD OF OPERATING HID SODIUM LAMP TO MINIMIZE LAMP VOLTAGE VARIATION THROUGHOUT LAMP LIFE

[75] Inventors: Ranbir S. Bhalla, Pine Brook, N.J.; Jose E. Tallet, Palm Bay; Robert T. Elms, Monroeville, Pa.

[73] Assignee: North American Philips Lighting Corporation, New York, N.Y.

[21] Appl. No.: 414,276

[22] Filed: Sep. 2, 1982

[51] Int. Cl.[3] ..... H05B 37/02

[52] U.S. Cl. ..... 315/307; 315/194; 315/227 R; 315/247; 315/308

[58] Field of Search ..... 315/194, 199, 227, 247, 315/307, 308, 363

[56] References Cited

U.S. PATENT DOCUMENTS

| | | | |
|---|---|---|---|
| 2,470,460 | 5/1949 | Bird | 315/194 |
| 3,778,669 | 12/1973 | Hoffman | 315/307 |
| 3,989,976 | 11/1976 | Tabor | 315/DIG. 4 |

*Primary Examiner*—Harold Dixon

[57] ABSTRACT

High-pressure-sodium HID lamps characteristically display an increasing operating voltage throughout life. The industry has established operating standards as a trapezoidal figure on a graph wherein lamp wattage is plotted on the axis of ordinates and lamp voltage is plotted on the axis of abscissas. The parallel trapezoid sides represent minimum permissible and maximum permissible operating lamp wattages and the remaining sides of the trapezoidal figure are two lines of sharply rising positive slope which represent minimum permissible and maximum permissible lamp voltages.

The lamp-life operating characteristics are describable by a curve which enters into the trapezoid through the line representing minimum lamp voltages and which exits from the trapezoid through the line representing maximum lamp voltages. To minimize lamp voltage variations throughout normally anticipated life, the lamp is initially operated for a relatively short period of time until the operating voltage is a predetermined value and the wattage consumption is relatively high as compared to the minimum value. Thereafter, the lamp is operated so that the operating characteristic curve of lamp wattage consumption versus increasing lamp operating voltage displays a slope which is negative in nature and which does not exceed an operating wattage drop of about 1.5 percent per one volt increase in lamp operating voltage. Thereafter, the lamp is operated in such manner that the characteristic operating curve ultimately exits from the trapezoidal figure proximate the lower right-hand portion thereof.

3 Claims, 7 Drawing Figures

METHOD OF OPERATING HID SODIUM LAMP TO MINIMIZE LAMP VOLTAGE VARIATION THROUGHOUT LAMP LIFE

CROSS-REFERENCES TO RELATED APPLICATIONS

In copending application Ser. No. 414,114, filed concurrently herewith, is disclosed a ballast modifying device and a modified lead-type ballast for programming and controlling the operating performance of an HID lamp. This copending application is a continuation-in-part of application Ser. No. 282,993, filed July 14, 1981 now abandoned which in turn is a continuation-in-part of application Ser. No. 264,324, filed May 18, 1981, all applications being by R. J. Spreadbury and owned by the present assignee.

In copending application Ser. No. 414,275, filed concurrently herewith by Engel et al. and owned by the present assignee is disclosed an improved packaging concept for a programming and control device wherein all elements thereof are included in a unitary package formed similarly to a capacitor can of such dimensions as to be readily mounted in existing HID lamp fixture designs.

In copending application Ser. No. 414,115, filed concurrently herewith, by J. C. Engel and owned by the present assignee is disclosed an improved programming and control device for a modified lead ballast for HID lamps. One embodiment of this programming and control device has been specifically tailored to operate HID sodium lamps in such manner that lamp voltage variations are minimized throughout lamp life.

BACKGROUND OF THE INVENTION

This invention relates to HID sodium lamps and, more particularly, to a method for operating such lamps in order to minimize lamp voltage variations throughout lamp life.

It is well known to modify the performance of high-intensity-discharge (HID) lamps by sensing a lamp operating parameter and controlling the lamp operation in accordance with this sensed parameter. One such modifying device is disclosed in aforementioned application Ser. No. 282,993, filed Jan. 14, 1981 now abandoned. In its preferred form, a series-connected additional inductor and a gate-controlled AC switch are connected in parallel across the capacitor of the lead-type ballast and a sensing and programming means operates to sense at least one lamp oprating parameter in order to control the proportion of time the AC switch is open and closed, in order to vary the current input to the lamp. The programming and control device of aforementioned copending application Ser. No. 414,115, filed concurrently herewith is particularly adapted to operate with such a modified lead ballast and this improved programming device has specifically been designed to operate an HID sodium lamp in accordance with the present invention.

Another system for controlling lamp wattage is disclosed in U.S. Pat. No. 4,162,429, dated July 24, 1979 to Elms et al. wherein lamp voltage and line voltage are sensed and these parameters are converted into separate signals which are fed into a ramp capacitor to control the charging rate thereof. When the ramp capacitor achieves a predetermined level of charge during each half cycle of AC energizing potential, an AC switch is gated to shift the current level to the operating lamp, in order to control the wattage input thereto. This particular circuit can be modified in order to control the lamp operation so that lamp voltage variations are minimized throughout lamp life.

Some types of HID sodium lamps are designed to operate with an increased loading in order to improve the color rendering of objects illuminated thereby, such as described in U.S. Pat. No. 4,230,964 dated Oct. 28, 1980 to Bhalla. This type of HID sodium lamp tends to display shifts in the operating lamp color temperature with increasing lamp voltage. While the overall performance of the lamp is not affected by such shifts in lamp color temperature, when a series of such lamps are operated in side-by-side fixtures, difference in the color appearance of such proximate lamps can be considered objectionable from an esthetic standpoint.

SUMMARY OF THE INVENTION

There is provided a method of operating a high-pressure-sodium high-intensity-discharge lamp in such manner as to substantially decrease variations in lamp operating voltage throughout lamp life. All such sodium HID lamps have a nominal rated operating wattage and a nominal rated operating voltage. The lamps characteristically display an increasing operating voltage throughout lamp life resulting in established standards which specify that the permissible relative wattage and voltage characteristics which are experienced throughout expected lamp operating life fall within the confines of an established trapezoidal figure on a graph wherein increasing lamp wattage is linearly plotted on the axis of ordinates and increasing lamp voltage is linearly plotted on the axis of abscissas. The parallel sides of the trapezoidal figure are defined by minimum permissible and maximum permissible operating lamp wattages and the remaining sides of the trapezoidal figure are defined by two lines of sharply rising positive slope wherein small increases in lamp operating voltage are reflected as relatively large increases in lamp operating wattage and which represent desired minimum permissible lamp voltages and desired maximum permissible lamp voltages at lamp operating wattages which may vary from the minimum permissible to the maximum permissible values as specified. The operating characteristics of the lamp throughout its normally anticipated life will vary somewhat with variations in line voltage but are describable by a humped curve which enters into the trapezoidal figure through the line representing minimum permissible lamp voltages and which curve exits from the trapezoidal figure through the line representing maximum permissible lamp voltages. Of course, each basically different lamp type has established therefor its own trapezoidal figure by which its performance is measured.

In accordance with the present invention, the lamp is initially operated for a relatively short period of time until the lamp voltage has attained a predetermined value and the operating wattage consumption of the lamp is relatively high as compared to the specified minimum wattage value at which the lamp can be operated. Thereafter, and commencing with the relatively high wattage consumption at which the lamp is operated at the termination of the first period of time, the lamp is continued to be operated but in such modified manner that the operating characteristic curve of lamp wattage consumption versus increasing lamp operating voltage displays a slope which is negative in nature and which does not exceed a lamp operating wattage drop of about 1.5 percent per one volt increase in lamp operating voltage, in order to insure stable lamp operation. The lamp is continued to be operated in such manner that the operating characteristic curve ultimately exits from the trapezoidal figure proximate the intersection of the line which describes the minimum permissible wattage value and the line which describes the maximum permissible voltage values.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
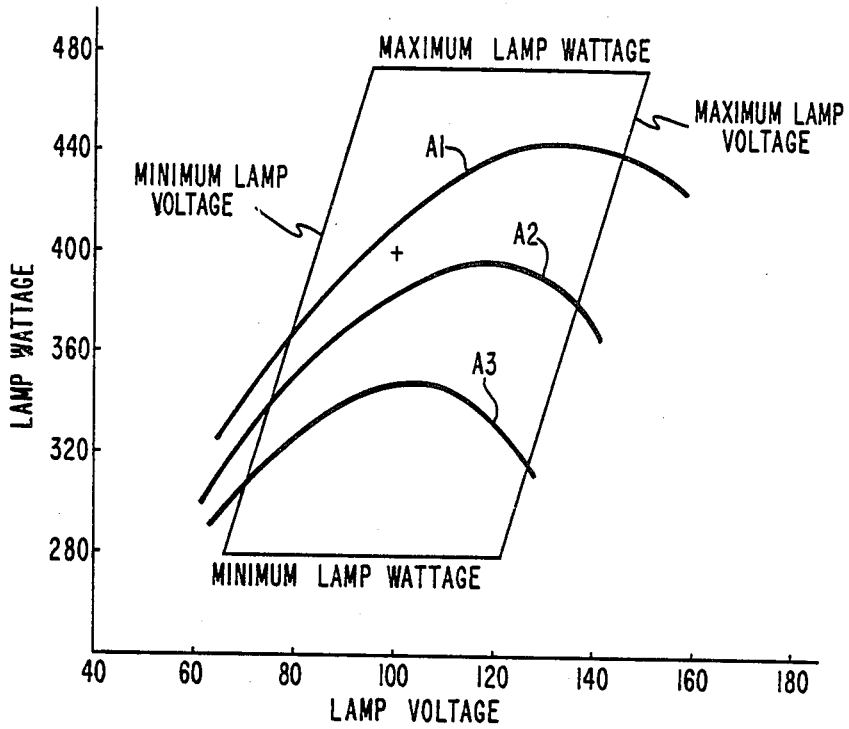
FIG. 1 is a graph of lamp wattage versus lamp voltage having inscribed thereon the so-called ANSI trapezoid for a 400 lamp on which three curves of lamp performance characteristics are inscribed, one curve for overline voltage, one curve for nominal line voltage and one curve for low line voltage.

High-intensity-discharge (HID) sodium lamps exhibit a rising voltage characteristic throughout their life. As a result, the lamp manufacturers through the American National Standards Institute have established trapezoidal figures which are used to define the permissible operating characteristics for the lamp and which are known in the art as ANSI trapezoids. Such a trapezoid is shown in FIG. 1 for a lamp which is nominally rated at 400 watts, 100 volts, with the nominal lamp rating being indicated by (+). Because of the increasing lamp voltage which is exhibited throughout lamp life, the industry specifies that the relative wattage and voltage operating characteristics which are experienced throughout expected lamp life should fall within the confines of these trapezoids. In the trapezoid as shown in FIG. 1, the parallel sides of the trapezoidal figure are defined by horizontal lines which set the desired minimum permissible and maximum permissible operating lamp wattages. The remaining sides of the trapezoidal figure are defined by two lines of sharply rising positive slope wherein small increases in lamp operating voltage are reflected as relatively large increases in operating lamp wattage and which represent desired minimum permissible lamp voltages and desired maximum permissible lamp voltages at operating wattages which vary from the desired minimum permissible to the maximum permissible wattages. The operating characteristics of such a lamp throughout its normally anticipated life are describable by a generally humped curve which enters into the trapezoidal figure through the line representing minimum permissible lamp voltages and which curve exits from the trapezoidal figure through the line which represents maximum permissible lamp voltages. Another factor which enters into lamp performance is line voltage and for a typical ballasted lamp of this rating, 10 percent high line voltage will produce a lamp performance curve such as is set forth in the curve designated A1. A lamp-ballast which is operated at nominal line voltage has a typical lamp performance such as shown in curve A2, and a lamp-ballast combination operated at 10 percent low line voltage has a typical lamp operating curve such as shown in curve A3. At the end of lamp life, the operating lamp voltage will have increased sufficiently that once the lamp is warmed up, the ballast will not sustain its operation and it tends to cycle "on and off" until the lamp is replaced.

Figure 2:
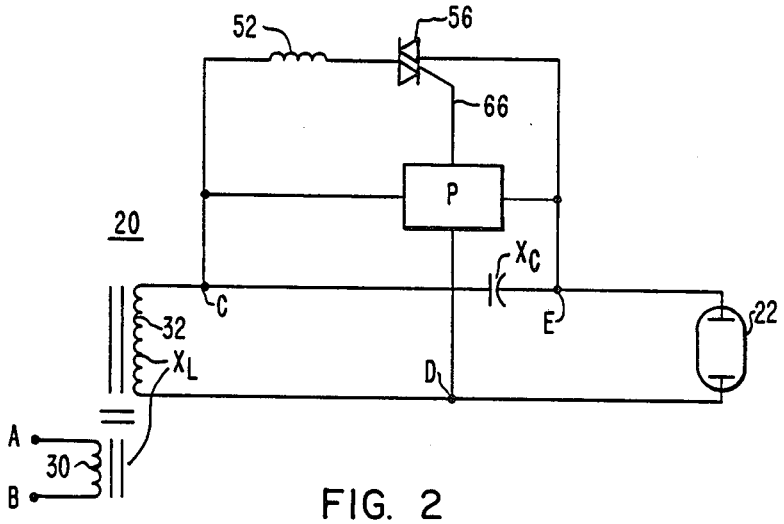
FIG. 2 is a diagrammatic showing of a conventional lead ballast which has been modified with a special programming device to operate the lamp in accordance with the present invention.

An HID sodium lamp can be operated in accordance with the present invention from any of a variety of different circuit and ballast arrangements, but in its preferred form, a so-called lead ballast circuit is modified to incorporate a controlling module P such as shown in FIG. 2. In this embodiment, the basic lead-type ballast apparatus 20 has apparatus input terminals A and B adapted to be connected across a source of AC energizing potential and apparatus output terminals E and D across which the lamp 22 to be operated is adapted to be connected. The ballast apparatus comprises an inductive reactance portion designated $X_L$ and a capacitive reactance portion designated $X_C$. The inductive reactance portion comprises a conventional current-limiting high-reactance transformer means which has a primary winding 30 connected to the apparatus input terminals A and B and a secondary winding 32 terminating in secondary winding output terminals C and D. The capacitive reactance portion comprises the capacitor $X_C$ connected in circuit between the secondary winding means output terminal C and the apparatus output terminal E. In conventional fashion, the high reactance transformer $X_L$ can have an autotransformer construction or it can be formed with separate windings.

The basic modifying device comprises additional inductance means 52 connected in series with a gate-controlled AC semiconductor switching means 56 which has a high impedance open position and a low impedance closed position and gate terminal means 66 which connect to the basic sensing and programming means P as described hereinafter. When the switching means 56 is open, the modified ballast apparatus delivers a first level of current to an operating lamp and when the switching means is closed, the modifying ballast apparatus delivers a second and lower level of current to an operating lamp. The sensing and programming means P is operable to sense the lamp operating voltage and to generate an output control signal which is indicative of the operating wattage desired for the operating lamp. The programming means has its output connected to the gate terminal 66 of the switch 56 to control the relative proportion of time the switching means is open and closed in order to control in programmed fashion the operating wattage desired for the operating lamp.

The initial lamp tests were conducted on the circuit as disclosed in aforementioned U.S. Pat. No. 4,162,429 which senses both lamp voltage and line voltage to generate a control signal. This circuit was modified slightly to compare lamp voltage to a reference signal which in turn produced an error signal and this in turn was used to decrease the lamp wattage input in accordance with increasing lamp voltage. However, the circuit as disclosed in copending application Ser. No. 414,115, filed concurrently herewith was specifically designed to operate a lamp in this fashion and is much preferred and will be described in detail hereinafter.

Figure 3:
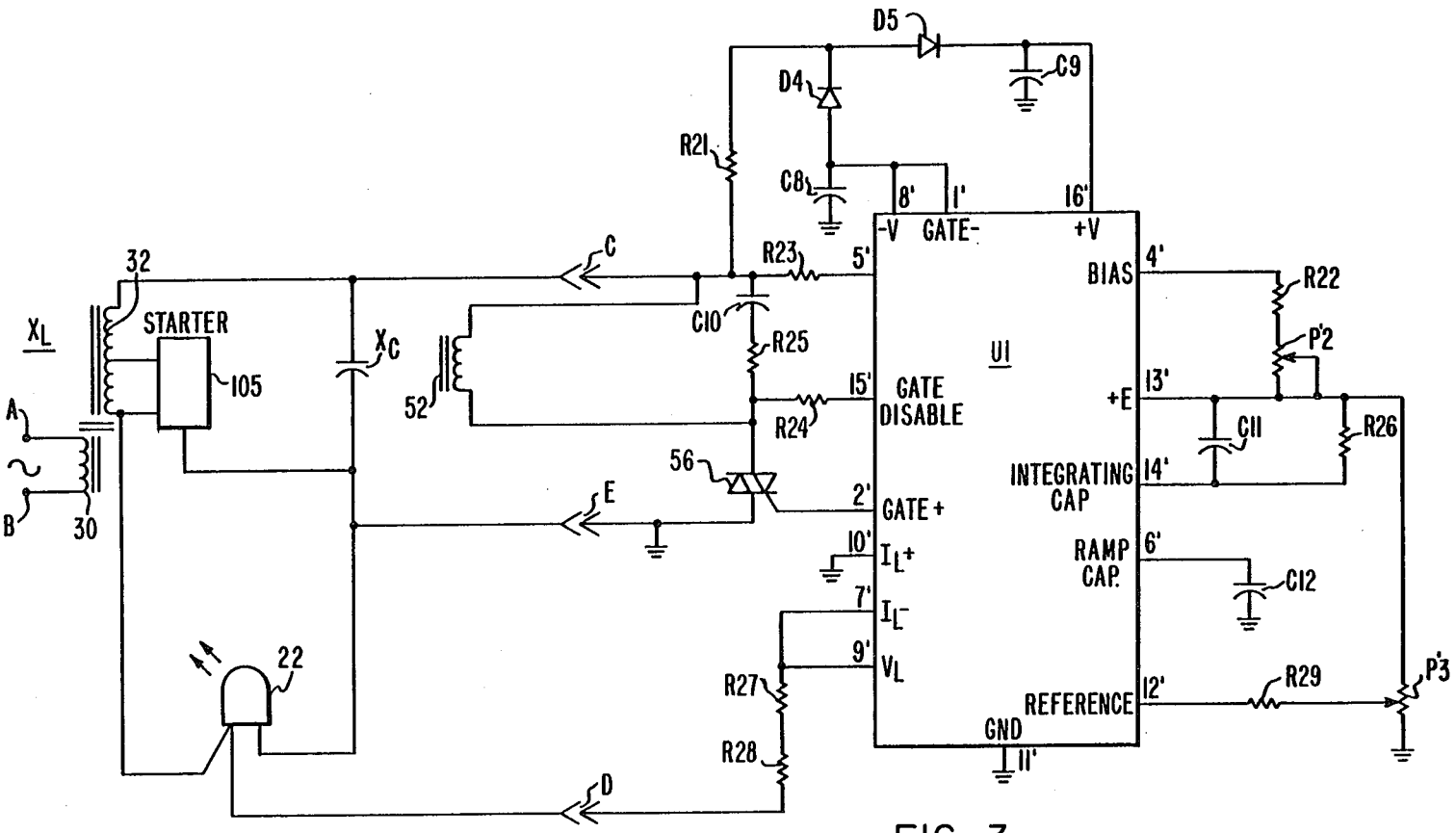
FIG. 3 is a circuit diagram of a voltage responsive control module which is connected with a conventional lead-type ballast in order to operate the lamp in accordance with the present invention.

Referring to the circuit shown in FIG. 3, connections to the conventional lead-type ballast are made at the indicated points C, D and E. There is also incorporated a conventional starter 105 which cooperates with the secondary winding 32 in order to provide high voltage starting pulses, such as 2500 volts. A wide variety of these starting circuits are available and a typical circuit is described in U.S. Pat. No. 4,072,878, dated Feb. 7, 1978.

The circuit as shown in FIG. 3 periodically measures the lamp operating voltage, once stable lamp operating conditions are achieved, in order to generate output signals which are representative of the measured voltages developed across the operating lamp. These are used to actuate means which cause the gate drive for the switch 56 to be actuated at a predetermined earlier time in each half cycle of the AC energizing potential at the measured lamp voltages increase. In other words, as the lamp operating voltage increase, the lamp wattage consumption is decreased at a predetermined rate in order that the lamp voltage increase is minimized. Thus, the modified control senses lamp voltage and reduces the lamp power once the voltage has passed a predetermined value of about 110 VAC in the case of a lamp rated at 100 VAC. Once the control is in effect, a representative wattage decrease, when plotted on a curve of watts versus volts, will display a negative slope of about one percent decrease in wattage per one volt increase in lamp operating voltage.

The circuit is described in great detail in aforementioned copending application Ser. No. 414,115, filed concurrently herewith and briefly, the resistor R26 parallels the integrating capacitor C11 and the voltage which appears across C11 is "zero" until the lamp is warmed up and its operating voltage achieves a value of approximately 110 VAC. At this time, the lamp voltage signal begins to exceed the reference signal causing the voltage across C11 to increase. This in turn causes the AC switch 56 to turn "on" which in turn reduces lamp power, thereby reducing the tendency for lamp voltage increase. The current through R26 is proportional to the voltage across C11 and is of the same polarity as the internal reference current, described hereinafter, which flows toward the INTEGRATING CAP terminal 14'. The current through R26 therefore has the effect of increasing this reference value.

Two adjustments P2 and P3 are provided. Potentiometer P2 is used to adjust the bias current into BIAS TERMINAL 4'. The ramp capacitor charging current equals twice the bias current and thus the ramp height can be adjusted. The maximum height is set equal to +E which provides a generally uniform slope for the lamp power versus voltage curve. The second potentiometer P2 sets the lamp voltage value at which the control becomes active. At the present time, for a lamp having a nominal voltage of 100 volts, the control is set to become operative when the measured lamp operating voltage reaches a value of about 110 VAC.

In the following Table I is set forth the parts list for the voltage control module as indicated in FIG. 3.

TABLE I

| COMP | DESCRIPTION | VALUE Ω | | | MFG. NUMBER | MFG. |
|---|---|---|---|---|---|---|
| R21 | Resistor | 100K | 5% | 2W | | |
| R22 | Resistor | 330K | 5% | .25W | | |
| R23 | Resistor | 4.7M | 5% | .25W | | |
| R24 | Resistor | 4.7M | 5% | .25W | | |
| R25 | Resistor | 2K | 5% | .25W | | |
| R26 | Resistor | 680K | 5% | .25W | | |
| R27 | Resistor | 2.7M | 5% | 1W | | |
| R28 | Resistor | 2.7M | 5% | 1W | | |
| R29 | Resistor | 330K | 5% | .25W | | |
| C8 | Capacitor | 18MFD | 20% | 15V | 196D186X0015JA1 | Sprague |
| C9 | Capacitor | 18MFD | 20% | 15V | 196D186X0015JA1 | Sprague |
| C10 | Capacitor | .028MFD | 5% | 600V | 715P3358LD3 | Sprague |
| C11 | Capacitor | 1MFD | 10% | 50V | RA1A105K | IMB |
| C12 | Capacitor | .015MFD | 20% | 50V | CW15-50-100-M | Central Lab |
| D4 | Diode | 400mA | | 225V | 1N645 | Gen Inst |
| D5 | Diode | 400mA | | 225V | 1N645 | Gen Inst |
| P2 | Potentiometer | 1M | 10% | 1 Turn | 3386-P-1-105 | Bourns |
| P3 | Potentiometer | 500K | 10% | 1 Turn | 3386-P-1-504 | Bourns |
| 56 | AC Switch | 4A | | 600V | Q6004 L4 | Teccor |
| U1 | Integrated Ckt | | | | MOA2953 | Interdesign |
| | Printed Circuit Board | | | | A81164 | |
| | Terminals | | | | 62409-1 | AMP |

Figure 4:
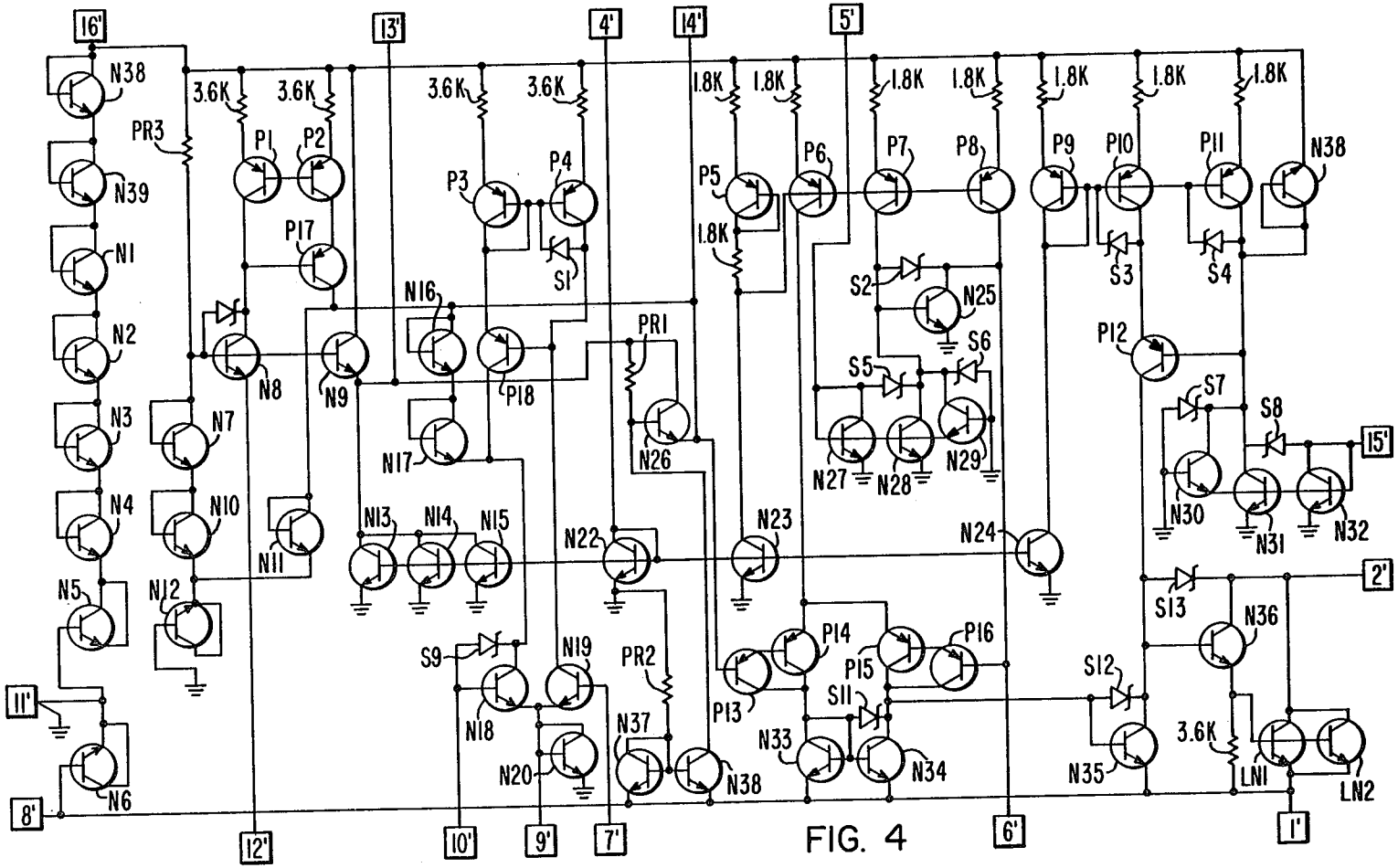
FIG. 4 is a circuit diagram of an I.C. chip which is an essential part of the programming device.

The integrated circuit U1 as shown in FIG. 4 is described in great detail in the aforementioned copending application Ser. No. 414,115, filed concurrently herewith and reference is made thereto for further details. Briefly, the integrated circuit design is based upon a "master array" concept which yields silicon wafers with thousands of identical "chips" which are completely processed except for the final device interconnect pattern on the surface of the chip. The advantage of this process is reduced cost and development time. The chip circuitry is shown in detail in FIG. 4 and in the following Table II are descriptions of the IC pins along with their functioning.

TABLE II

DESCRIPTION OF I.C. PINS

| PIN | LABEL | FUNCTION |
|---|---|---|
| 1' | GATE– | Negative (Emitter) side of 200mA NPN Switch which is used to turn the AC |

TABLE II-continued

DESCRIPTION OF I.C. PINS

| PIN | LABEL | FUNCTION |
|---|---|---|
| | | switch on by connecting the gate to a negative voltage source. |
| 2' | GATE+ | Positive (Collector) side of NPN Switch |
| 3' | Not Used or Shown | |
| 4' | BIAS | Current $I_b$ (bias current) into this terminal forms a source for various internal biasing circuits and current references. The value of $I_b$ can range from 5 to 50 μA. The voltage at the terminal is 0.7 V above GND terminal 15'. |
| 5' | RAMP RESET | Whenever the magnitude of the current in or out of this terminal drops below 2 $I_b$, the RAMP CAP terminal 6' is shorted to the GND terminal 15' by an NPN transistor. Maximum current should be limited to ±300 μA. The voltage clamps at ±0.7 V. |
| 6' | RAMP CAP | The current flow out of this terminal equals 2 $I_b$ and is used to turn a linear voltage ramp signal. The voltage range is from 0 V (reset active) to +V. The voltage at this terminal is internally compared with the voltage at INTEGRATING CAP terminal 14' to control the gate current. |
| 7' | $I_{L-}$ | The voltage difference between this terminal and $I_{L+}$ is used in combination with the current flow out of $V_L$ terminal 9' to form a transconductance multiplier whose output is proportional to instantaneous lamp power. The multiplier is a single quadrant design which functions when $I_{L+} - I_{L-}$ is 0 (for best linearity 30 mV) and the current from $V_L$ terminal is positive. In the present lamp voltage regulating configuration the multiplier is converted to a single transistor, grounded base, network whose output equals the current flowing from $V_L$ terminal 9'. This is accomplished by connecting $I_{L-}$ to $V_L$ and grounding $I_{L+}$. |
| 8' | −V | Negative shunt regulator referenced to GND terminal 11'. Voltage is nominally −6.7 V. Current flow from terminal 8' should be limited to less than 10 mA. The substrate of the chip is connected to −V and thus all other chip terminals must be positive with respect to −V. |
| 9' | $V_L$ | See description of Pin 7'. |
| 10' | $I_{L+}$ | See description of Pin 7'. |
| 11' | GND | Ground reference of circuit. |
| 12' | REFERENCE | Voltage at this terminal (nominal value of 7.4 V) is temperature compensated and independent of the ripple voltage of +V terminal 16'. The current flow from this terminal is internally compared to the output of the multiplier and thus forms the power reference signal. Current should nominally be 10–20 μA. |
| 13' | +E | Voltage at this terminal is nominally 7.4 V. Terminal can source about 300 μA and can sink 3 $I_b$ and can thus handle ripple current of the integrating capacitor. |
| 14' | INTEGRATING CAP | This high impedance terminal is the summing point for the current proportional to lamp power and the power reference $I_{REF}$. Voltage can range from 1 V to 7.4 V. |
| 15' | GATE DISABLE | The AC switch gate current circuit is disabled whenever the current flow from or to this terminal exceeds $I_b$. The current should be limited to ±300 μA and the voltage is internally limited to ±0.7 V. |
| 16' | +V | A shunt 10.9 V Zener referenced to GND terminal 11'. The current flow should be limited to 10 mA and the terminal must be most positive of chip. |

The following Table III is a general description of the components of the I.C. chip.

TABLE III

DESCRIPTION OF I.C. CHIP COMPONENTS

| Chip Component | Description |
|---|---|
| N 1 through 40 | NPN transistors (signal level) |
| P 1 through 18 | PNP transistors (signal level) |
| S 1 through 13 | Schottky diodes |
| LN1 and LN2 | Medium power level NPN transistors |
| PR1 and PR2 | Pinch resistors 130 KΩ |
| PR 3 | Pinch resistor 100 KΩ |
| Other resistors | 3.6 KΩ or 1.8 KΩ as marked |

Figure 5:
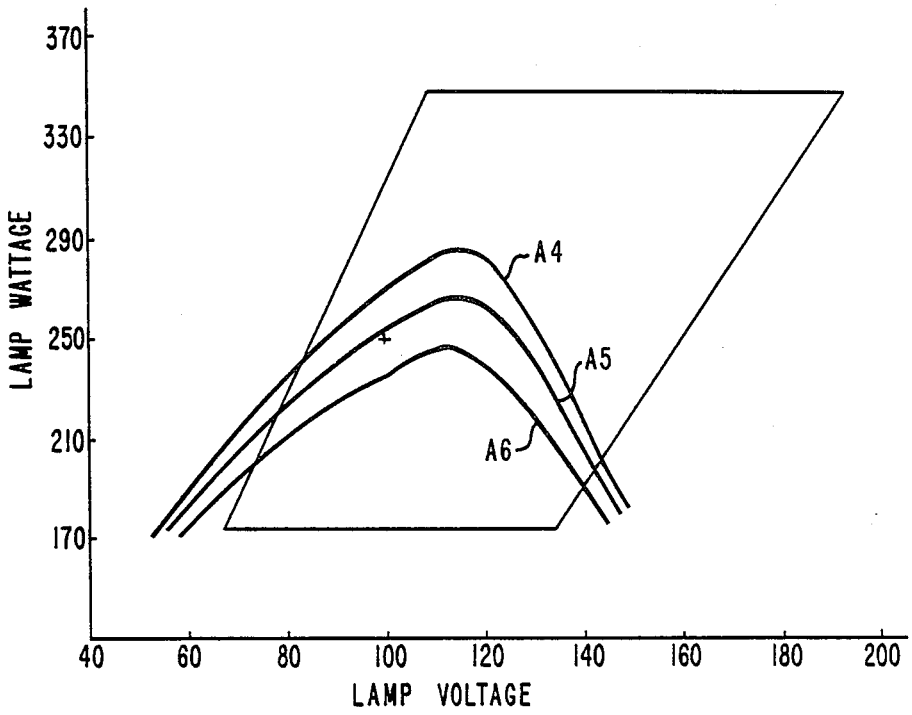
FIG. 5 is a graph of wattage versus voltage for a sodium lamp nominally rated at 250 watts and operated under varying line voltage conditions in accordance with the present invention.
Figure 6:
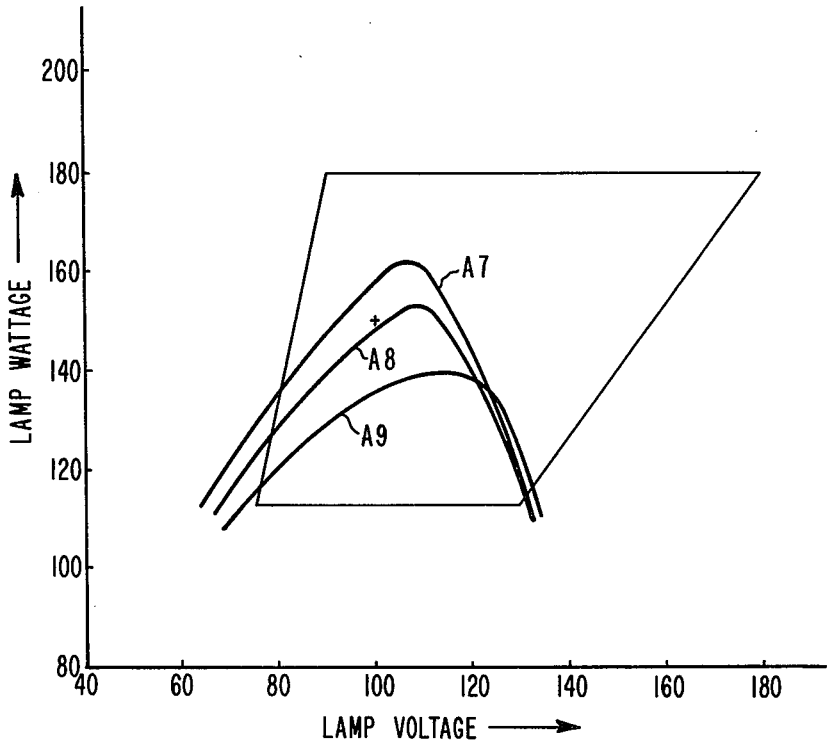
FIG. 6 is a curve similar to FIG. 5 except that the lamp has a nominal rating of 150 watts.

In the preferred mode for operating the lamp to minimize the voltage increases, the lamp is operated without any control unitl its wattage consumption, as determined by its measured voltage, is relatively high as compared to the specified minimum wattage value at which the lamp can be operated. Normally, at nominal lamp voltage, the initial operating lamp wattage, prior to control thereof, will approximate its nominal value, such as 250 watts in the case of a lamp rated at 250 watts. However, this need not be the case and the initial lamp wattage, prior to control, can be higher or lower if desired. Once the initial desired lamp wattage consumption is achieved, the control becomes effective and thereafter and commencing with the relatively high initial lamp wattage consumption, the lamp is operated in such manner that the operating characteristic curve of lamp wattage consumption versus increasing lamp voltage displays a slope which is negative in nature. This slope should not exceed a lamp operating wattage drop of about 1.5 percent per one volt increase in lamp operating volts in order to insure stable lamp operation. In other words, if the lamp wattage consumption is dropped too rapidly, some lamp instability may result. The lamp is then operated in this manner until the operating characteristic curve ultimately exits from the trapezoidal figure proximate the intersection of the line which describes the minimum permissible wattage value and the line which describes the maximum permissible voltage values. Such a mode of operation is shown in FIG. 5 for a lamp which has a nominal rating of 250 watts, 100 volts. The curve A4 is plotted for a lamp operated from a line voltage which is 10 percent higher than nominal, the curve A5 is for nominal line voltage operation and the curve A6 is for 10 percent under nominal line voltage. A similar set of curves is shown in FIG. 6 for a 150 watt lamp wherein the lamp trapezoid is plotted with the lamp operating characteristics shown thereon. The curve A7 is for 10 percent over-line voltage, the curve A8 is taken for nominal line voltage and the curve A9 is taken for 10 percent underline voltage.

Figure 7:
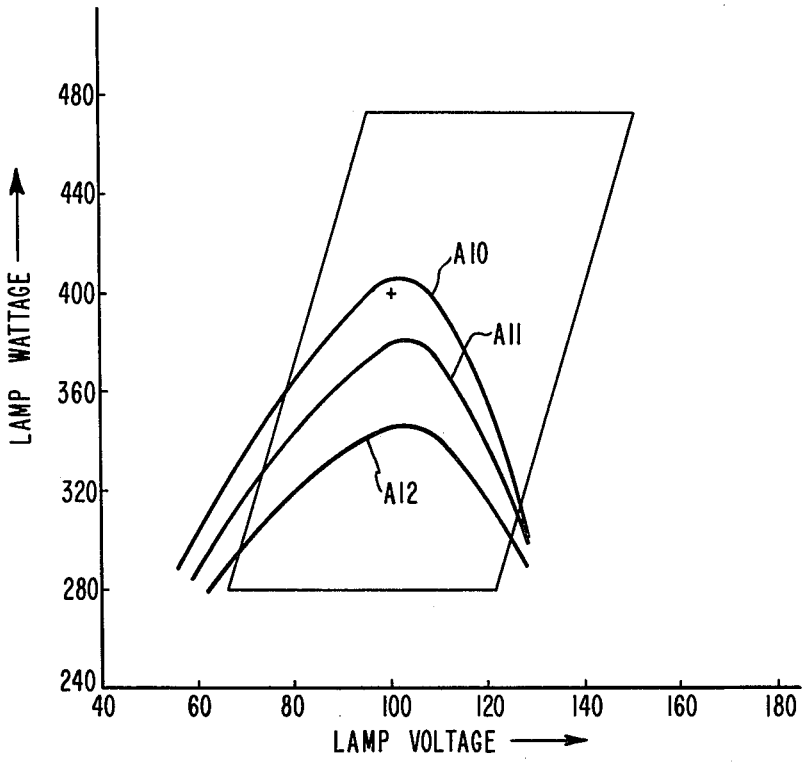
FIG. 7 is a graph similar to FIGS. 5 and 6 except that the lamp has a nominal rating of 400 watts.

A similar set of curves is shown in FIG. 7 for a lamp nominally rated at 400 watts, 100 volts wherein the curve A10 is taken for a lamp operated from 10 percent over-line volts, the curve A11 is taken for a lamp operated from nominal line voltage and the curve A12 is taken for a lamp operated from 10 percent under-line voltage. A commercial embodiment for such a lamp-ballast combination would desirably utilize a slightly larger value of capacitive reactance, ($X_C$), such as 52 MFD instead of 48 MFD, to raise the curves somewhat.

As shown from these curves of FIGS. 5–7, for the majority of the operating life of the lamp, the increase in lamp voltage which is normally encountered is minimized and for those particular HID sodium lamps which are sensitive to color temperature shifts with respect to increasing voltage, it is highly desirable to minimize the increases in lamp voltages as much as possible.

In the foregoing preferred circuit embodiment as described, the lamp control device is not operative until the lamp is warmed up and the add-on inductor 52 can be wound to operate at the maximum capacitor voltage ($X_C$) expected with minimum lamp voltages, typically in the order of about 80 volts. In practice, the size of the series capacitor $X_C$ increases with increasing ballast rating. At a given lamp voltage, the higher current encountered with increasing ballast rating thus produces approximately the same voltage drop across the series ballast capacitor $X_C$. Thus every lead-type ballast rating will have the same maximum voltage rating for the add-on inductor 52. The actual value of the inductor 52 is not critical and a typical rating for the inductor is 159 mH.

It is preferred to operate the lamps, after the relatively short first period of time, in such manner that the curve of power vs. voltage has a negative slope which is generally uniform, as shown in FIGS. 5–7. As a possible alternative method of operation, the value of the add-on inductor 52 could be increased so that with the add-on inductor 52 phased "in" at all times, the characteristic curve of power vs. volts would approach, but not fall beneath, the minimum permissible lamp wattage line of the appropriate trapezoid. With such a modified construction, the lamp 22 would be operated during the relatively short first period of time in the manner as described hereinbefore. Once voltage-wattage control was effective, the negative slope of the lamp operating curve would be increased so as to approach the value of about 1.5% decrease in wattage per one volt increase in lamp voltage. This mode of lamp operation would be continued until the add-on inductor 52 was fully phased "in". The operating characteristic curve would then assume a generally horizontal slope for the remainder of the lamp life until it exited from the trapezoid, proximate the lower right-hand corner thereof. For such a modified mode of operation, the add-on inductor 52 could be increased from 159 mH to 700 mH.

What we claim is:

1. The method of operating a high-pressure-sodium high-intensity-discharge lamp in such manner as to substantially decrease variations in lamp operating voltage throughout lamp life, said lamp having a nominal rated operating wattage and a nominal rated operating voltage, said lamp characteristically displaying an increasing operating voltage throughout its life resulting in established operating standards which specify that the permissible relative wattage and voltage operating characteristics which are experienced throughout expected lamp operating life fall within the confines of an established trapezoidal figure on a graph wherein increasing lamp wattage is linearly plotted on the axis of ordinates and increasing lamp voltage is linearly plotted on the axis of abscissas, the parallel sides of the trapezoidal figure being defined by minimum permissible and maximum permissible operating lamp wattages, and the remaining sides of the trapezoidal figure defined by two lines of sharply rising positive slope wherein small increases in lamp operating voltage are reflected as relatively large increases in operating lamp wattage and which represent desired minimum permissible lamp voltages and desired maximum permissible lamp voltages at operating lamp wattages which vary from said minimum permissible to said maximum permissible operating lamp wattages, and the operating characteristics of said lamp throughout its normally anticipated life are describable by a curve which enters into the trapezoidal figure through said line representing minimum permissible lamp voltages and which curve exits from the trapezoidal figure through said line representing maximum permissible lamp voltages, which method comprises:

initially operating said lamp for a relatively short first period of time until the operating voltage thereof has attained a predetermined value and the wattage consumption of said lamp is relatively high as compared to said specified minimum wattage value at which said lamp can be operated; and thereafter and commencing with said relatively high wattage consumption at which said lamp is operated at the termination of said first period of time, continuing to operate said lamp but in such manner that the operating characteristic curve of lamp wattage consuption vs. increasing lamp operating voltage displays a slope which is negative in nature and which does not exceed a lamp operating wattage drop of about 1.5% per one volt increase in lamp operating volts to insure stable lamp operation, and continuing to operate said lamp in such manner that said operating characteristic curve ultimately exits from said trapezoidal figure proximate the intersection of the line which describes said minimum permissible wattage value and the line which describes said maximum permissible voltage values.

2. The method as specified in claim 1, wherein at the end of said first period of time, the lamp wattage consumption and the lamp operating voltage approximate the nominal values, and said lamp is thereafter operated in such manner that the operating characteristic curve of lamp wattage consumption versus lamp operating voltage displays an operating wattage drop of about 1% per one volt increase in operating voltage.

3. The method as specified in claim 1, wherein after said relatively short first period of time, said lamp is operated in such manner that said operating characteristic curve displays a negative slope that is generally uniform.

* * * * *

UNITED STATES PATENT AND TRADEMARK OFFICE

CERTIFICATE OF CORRECTION

PATENT NO. : 4,475,065

DATED : October 2, 1984

INVENTOR(S) : RANBIR S. BHALLA ET AL

It is certified that error appears in the above-identified patent and that said Letters Patent is hereby corrected as shown below:

Col. 1, line 17, Delete "the present assignee" and insert

--Cooper Industries, Inc.--;

Lines 19-20, Delete "the present assignee" and insert

--Cooper Industries, Inc.--;

lines 27-28 Delete "the present assignee" and insert

--Cooper Industries, Inc.--.

Claim 1, (Col. 10) line 37, Delete "consuption" and insert --consumption--.

Signed and Sealed this

*Fifteenth* Day of *October 1985*

[SEAL]

*Attest:*

*Attesting Officer*

DONALD J. QUIGG

*Commissioner of Patents and Trademarks—Designate*